United States Patent [19]

Tackett

[11] Patent Number: 4,834,676

[45] Date of Patent: May 30, 1989

[54] SOLDERLESS WEDGE-LOCK COAXIAL CABLE CONNECTOR

[75] Inventor: Craig A. Tackett, Hobe Sound, Fla.

[73] Assignee: Solitron Devices Incorporated, Riviera Beach, Fla.

[21] Appl. No.: 162,422

[22] Filed: Mar. 1, 1988

[51] Int. Cl.[4] ..... H01R 17/04

[52] U.S. Cl. ..... 439/584

[58] Field of Search ..... 439/570–585

[56] References Cited

U.S. PATENT DOCUMENTS

| | | | |
|---|---|---|---|
| 3,184,706 | 5/1965 | Atkins . | |
| 3,498,647 | 3/1970 | Schroder . | |
| 3,846,738 | 11/1974 | Nepovim . | |
| 3,963,320 | 6/1976 | Spinner | 439/584 |
| 3,985,418 | 10/1976 | Spinner | 439/584 |
| 4,331,374 | 5/1982 | Phillips . | |
| 4,408,822 | 10/1983 | Nikitas . | |
| 4,456,323 | 6/1984 | Pitcher et al. . | |
| 4,557,546 | 12/1985 | Dreyer . | |
| 4,596,434 | 6/1986 | Saba et al. . | |
| 4,668,043 | 5/1987 | Saba et al. . | |

*Primary Examiner*—Joseph H. McGlynn

*Attorney, Agent, or Firm*—Staas & Halsey

[57] ABSTRACT

A wedge-lock type coaxial cable connector includes a main body, a ferrule locatable inside the rear end of the main body and a coupling nut. The rear end of the main body has a frusto-conical inner surface and the ferrule has a matching frusto-conical outer surface as well as an axial slit completely therethrough. When opposing forces are exerted against the rear surface of the ferrule, the ferrule is compressed and a barb on the inner surface of the ferrule engages the coaxial cable. Preferably, frusto-conical surfaces of the main body and the ferrule have interlocking axial indentations and protrusions to prevent relative axial and radial movement.

10 Claims, 4 Drawing Sheets

SOLDERLESS WEDGE-LOCK COAXIAL CABLE CONNECTOR

BACKGROUND OF THE INVENTION

1. Field of the Invention

The present invention is related to a coaxial cable connector, and, more particularly, to a coaxial cable connector of the wedge-lock type with a minimum number of parts.

2. Description of the Related Art

One objective in designing coaxial cable connectors is to provide good physical and electrical contact between the coaxial cable to which the connector is attached and a jack or another connector. In addition, it is desirable to obtain these results with a connector which is easily produced and easily assembled on the ends of coaxial cables. Numerous variations in design have been used in an effort to attain these objectives. Two catagories of connectors, each of which include many variations, are crimp-type and wedge-lock type connectors. In the crimp-type, a crimp tool is used to physically compress a malleable portion of the connector to engage it with the coaxial cable. In the wedge-lock type of connector, the threading of a nut causes compression of a portion of the connector to similarly engage the coaxial cable.

There are at least two types of wedge-lock connectors. In the first, a separate wedge nut is threated into the main body of the connector. This provides a relatively secure physical contact between the coaxial cable and the connector, but requires an undesirably large number of components. Examples of this type include U.S. Pat. Nos. 4,408,822 and 4,456,323. Other wedge-lock type connectors dispense with the extra nut at the rear of the main body and rely on the pressure exerted by the coupling nut, when threaded for the first time onto a jack, to engage other elements of the connector. Examples of this type of connector include U.S. Pat. Nos. 3,498,647; 3,985,418 and 4,557,546. While the number of parts is reduced somewhat, each of these still require an excessive amount of machining and often are less than satisfactory in securing the connector to the coaxial cable.

All three of the last mentioned patents describe a coaxial cable connector having at least slightly sloping and abutting surfaces on inner and outer annular members. All of these connectors are assembled when a rear-most member is slid over and around a front member which has some type of serrated inner surface that engages the outer surface of the coaxial cable. However, only the '647 patent includes any means for engagement between the front and rear annular members. A snap ring is carried by a circumferential groove in the inner surface of the rear annular member until it reaches a matching circumferential groove on the outer surface of the front annular member. Further compression of the connector is prevented by the snap ring and the annular members are secured to each other only if the grooves can be aligned with the snap ring in between.

SUMMARY OF THE INVENTION

An object of the invention is to provide a coaxial cable connector with a minimum number of parts.

Another object of the present invention is to provide a coaxial cable connector with a minimum parts that can be easily secured to a coaxial cable in proper alignment at the end thereof.

A further object of the present invention is to provide a coaxial cable connector which can be secured on a coaxial cable without any damage to the connector.

In accordance with the present invention, the foregoing and other objects are achieved by a coaxial cable connector including a main body having a front end with generally cylindrical inner and outer surfaces and a rear end with a generally cylindrical outer surface and a frusto-conical inner surface with front and rear diameters; a ferrule, locatable inside the rear end of the main body, having an axial slit completely therethrough, a rear surface, a generally cylindrical inner surface, a barb on the generally cylindrical inner surface and a frusto-conical outer surface with front and rear diameters, the front diameters of the frusto-conical surfaces of the main body and the ferrule being smaller than the rear diameters of the frusto-conical surfaces of the main body and the ferrule; and a coupling nut having a threaded inner front surface and a rear shoulder with an inner diameter smaller than the rear diameter of the frusto-conical surface of the ferrule, the barb on the generally cylindrical inner surface of the ferrule being forced into the cable when the coupling nut is first threaded onto a jack, causing the ferrule to be radially compressed and closing the axial slit therein, due to force exerted by the rear shoulder of the coupling nut against the rear surface of the ferrule and the frusto-conical surface of the main body against the frusto-conical surface of the ferrule.

Preferably, the front diameters of the frusto-conical surfaces of the main body and the ferrule are larger than the diameter of the generally cylindrical inner surface at the front end of the main body and the rear diameter of the frusto-conical surface of the ferrule is preferably larger than the rear diameter of the frusto-conical surface of the main body both before and after compression. Preferably, the frusto-conical surfaces of the main body and the ferrule meet in substantially face-to-face contact in an interlocking manner when the ferrule is compressed. This is preferably accomplished by knurling the frusto-conical surface of the ferrule with axially oriented protrusions and providing on the frusto-conical surface of the main body axially extending indentations corresponding in shape to the axially oriented protrusions on the frusto-conical surface of the ferrule.

These objects, together with other objects and advantages which will be subsequently apparent, reside in the details of construction and operation as more fully hereinafter described and claimed, reference being had to the accompanying drawings forming a part thereof, wherein like reference numerals refer to like parts throughout.

DESCRIPTION OF THE PREFERRED EMBODIMENTS

Figure 1:
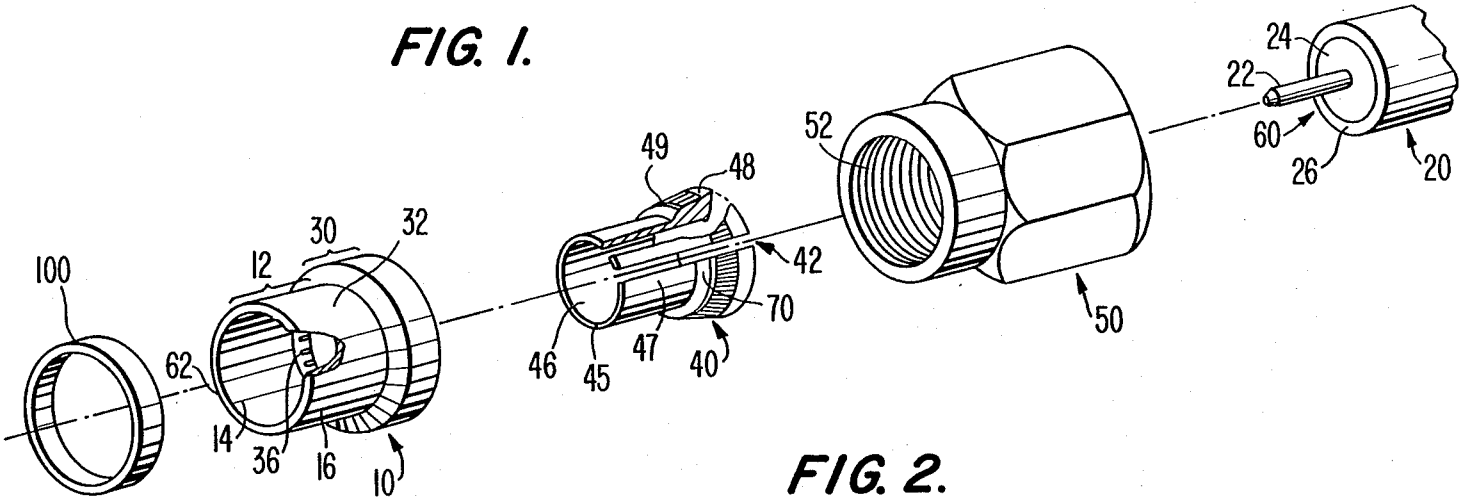
FIG. 1 is an exploded diagram of a coaxial cable connector according to a first embodiment of the present invention.

As illustrated in FIG. 1, a coaxial cable connector according to the present invention includes a main body 10 having a front end or front portion 12 with a front end surface 62 and generally cylindrical inner 14 and outer 16 surfaces. These inner and outer surfaces 14 and 16 are formed by a relatively thin wall which makes electrical contact with the outer conductor of a jack (not shown) to which the connector connects the coaxial cable 20. The coaxial cable 20 includes an inner conductor 22, a cable dielectric 24 and an outer conductor 26.

The main body 10 has a rear end or rear portion with a generally cylindrical outer surface 32 and a frusto-conical inner surface 34 having body scores or indentations 36 on the surface 34. The rear end 30 of the main body 10 is preferably generally thicker than the front end 12 to provide structural rigidity, as explained in more detail later.

Figure 2:
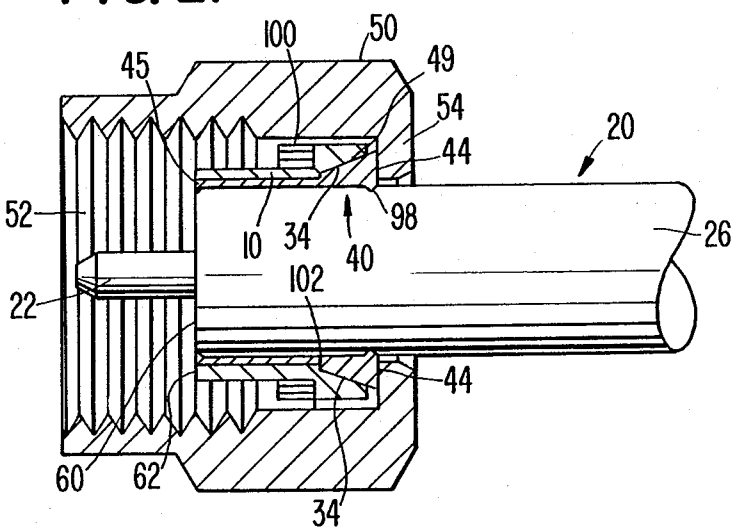
FIG. 2 is an axial cross-sectional view of an assembled coaxial cable connector according to the first embodiment of the present invention.
Figure 3:
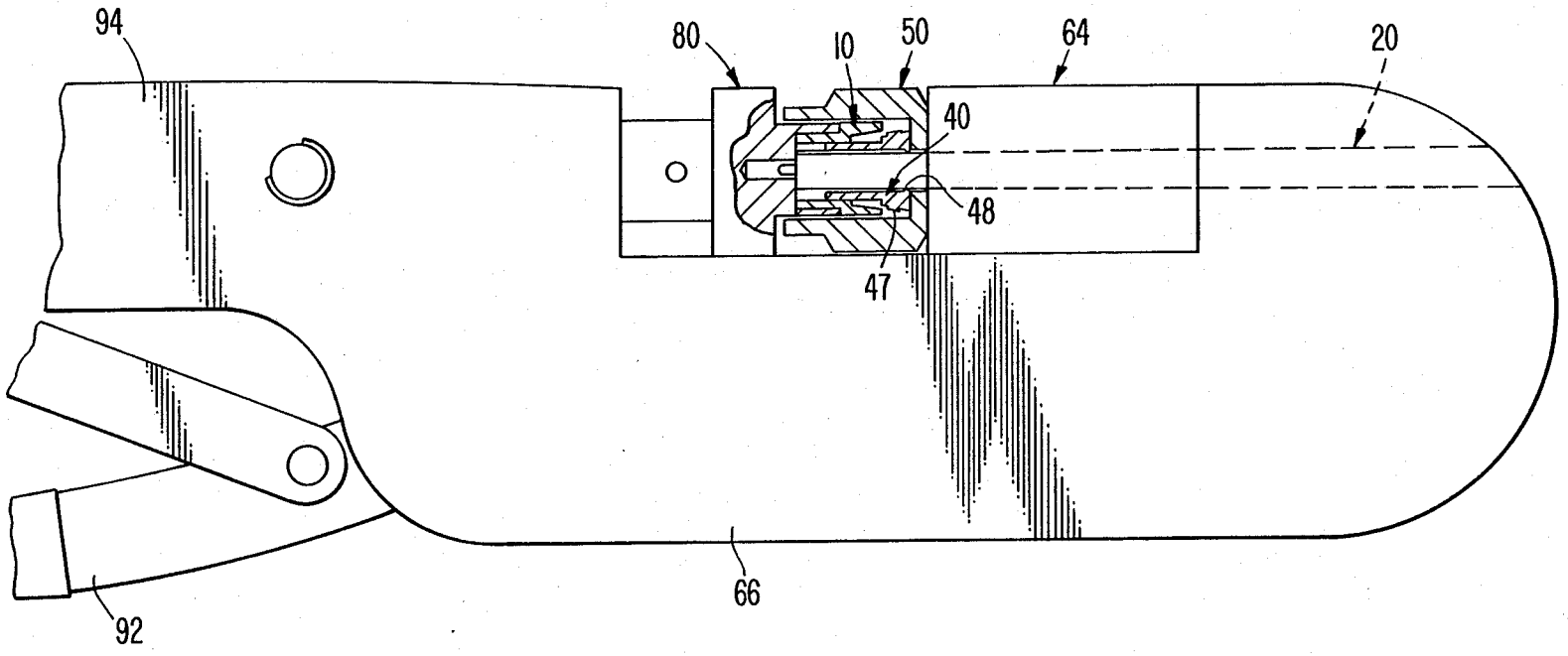
FIG. 3 is a side view with partial cross-section of an assembly tool for attaching a coaxial cable connector according to the present invention to a coaxial cable.

A ferrule 40 is locatable between the rear end of the main body 10 and the coaxial cable 20. As illustrated in FIG. 1 and in cross-section in FIG. 2, the ferrule 40 has an axial slit 42 completely therethrough, a rear end surface 44, a front edge or front end surface 45, a generally cylindrical inner surface 46, a front cylindrical outer surface 47 and a frusto-conical rear outer surface 48 including a knurled region 49. In the preferred embodiment, body scores 36 are formed on the frusto-conical inner surface 34 of the main body 10 and the knurled region 49 on the frusto-conical outer surface 48 of the ferrule 40 is raised slightly above the surrounding surface as best illustrated in FIG. 3.

The only other essential element of the connector is a coupling means for receiving a corresponding connector jack (not shown). In the embodiment of FIG. 1, the coupling means comprises a coupling, nut 50 having a threaded inner front surface 52 and a rear shoulder 54 (FIG. 2) with an inner diameter smaller than the rear diameter of the frusto-conical outer surface 48 of the ferrule 40.

The connector is assembled on a coaxial cable 20 which has been prepared by stripping a portion of the cable dielectric 24 and outer conductor 26 to expose the inner conductor 22 and to form an end face 60 as illustrated in FIG. 1. After the coaxial cable 20 has been prepared in this manner, the coupling nut 50, the ferrule 40 and the main body 10 are slid over the end face 60 of the coaxial cable 20, in that order. Then, the front surface 62 of the main body 10 is aligned with the end face 60 of the coaxial cable 20, as illustrated in FIG. 2. The coupling nut 50 is slid forward until the rear shoulder 54 of the coupling nut 50 is in contact with the rear surface 44 of the ferrule 40. While maintaining the front surface 62 of the main body 10 in alignment with the end face 60 of the coaxial cable 10, the cable 20 and connector assembly 20, 40 and 50 are positioned in an anvil 64 of an assembly tool 66 like that illustrated in FIG. 3.

Figure 4B:
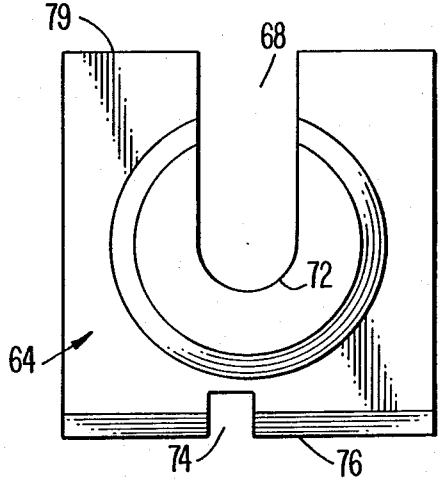
FIGS. 4A and 4B are side and front views, respectively of a locator used in the assembly tool illustrated in FIG. 3.

As best illustrated in FIG. 4B, the anvil 64 has a deep groove 68 in its top surface 79. The bottom 72 of the deep groove 68 is semi-cylindrical and has a diameter slightly larger than the outer diameter of the coaxial cable 20 so that the coaxial cable 20 can be inserted into the deep groove 68 and supported by the bottom 72 of the deep groove 68. The anvil 64 preferably includes alignment means such as notch 74 on the bottom surface 76. The notch 74 cooperates with corresponding alignment means (not shown) on the assembly tool 66 to maintain proper alignment of the anvil 64 in the assembly tool 66. The assembly tool 66 can be used for assembling different coaxial cable connectors, therefore, the anvil 64 and locator 80 are removable pieces which are sized to match the cable 20 and the connector main body 10.

Figure 5B:
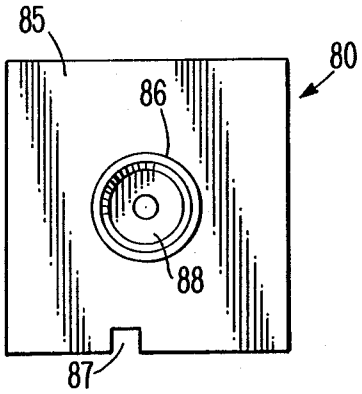
FIGS. 5A and 5B are side and front views, respectively of an anvil used in the assembly tool illustrated in FIG. 3.
Figure 4A:
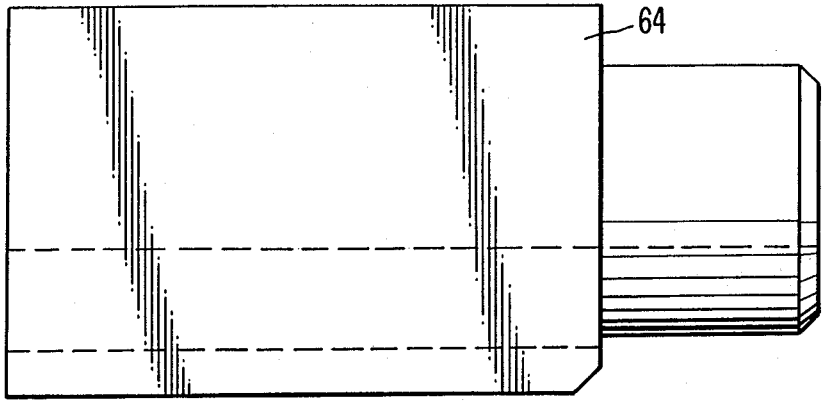
Figure 5A:
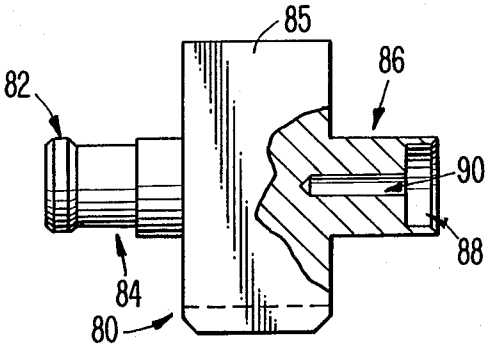

The locator 80 is illustrated in detail in FIGS. 5A and 5B. In the partial cross-sectional side view of FIG. 5A, securing means 82 is illustrated as a snap-in formed by an enlarged beveled end of a cylindrical rear 84 of the locator 80. The snap-in 82 enables the locator to be removably secured to the assembly tool 66. Other means for securing the locator 80 to the assembly tool 66, including latching mechanisms, may also be used. The locator 80 has a center block 85 and a cylindrical front end 86 with an outer diameter smaller than the inner diameter of the coupling nut 50 and a front well 88 with an inner diameter larger than the outer diameter of the front end 12 of the main body 10. In addition, a deep well 90 is formed in the center of the front well 88. The deep well 90 is cylindrical with an inner diameter larger than the diameter of the inner conductor 22 of the coaxial cable 20. As best illustrated in FIG. 5B, an alignment notch 87 is provided on the locator to perform a function similar to the alignment notch 74 on the anvil 64.

As illustrated in FIG. 3, after the coaxial cable 20 and connector assembly 10, 40, 50 is inserted in the anvil 64, a lever 92 on the assembly tool 66 is activated moving the front end 86 of the locator 80 inside the coupling nut 50 and surrounding the front end 12 of the main body 10. As the lever 92 is pressed tighter against the handle 94 of the assembly tool 66, the locator 80 pushes the coaxial cable 20 and main body 10 towards the anvil 64, while the coupling nut 50 and ferrule 40 are held in place by the anvil 64. As the main body 10 slides over the ferrule 40, the ferrule 40 is radially compressed, causing the axial slit 42 to be substantially closed and a barb 98 to engage the outer conductor 26 of the coaxial cable 20. In addition, the body scores 34 of the main body 10 are engaged with the knurled portion 49 of the ferrule 40. When the locator 80 stops moving, e.g., because the center block 85 comes in contact with the coupling nut 50, the front edge 45 of the ferrule 40 will be substantially aligned with front surface 62 of the main body 10 and end face 60 of the coaxial cable 20.

The preferred method of assembling the first embodiment of the connector utilizes the assembly tool 66 as described above. However, it is also possible to assemble the connector using a conventional or dummy jack and threading the coupling nut onto the jack using a conventional wrench. The force of the coupling nut against the rear surface 44 of the ferrule 40 causes the ferrule 40 to be compressed by the main body 10 and results in the final position of the ferrule 40, main body 10 and coaxial cable 20 illustrated in FIG. 2. After the connector has been assembled by either of these methods, a gasket 100 is inserted over the front end 12 and slid back to the rear end 30 of the main body 10 to the position illustrated in FIG. 2.

The present invention also lends itself to automated assembly. The anvil 64 and locator 80 can be inserted in an automatic assembler into which pre-aligned connector assembles and coaxial cables can be inserted using conventional automated assembly techniques.

During assembly by any of the above methods, as the ferrule 40 is radially compressed, the body scores or indentations 36 on the inner frusto-conical surface 34 of the main body 10 engage the knurled portion 49 of the outer frusto-conical surface 48 of the ferrule 40. Preferably, the knurled portion 49 is formed by axially oriented protrusions forming a raised area on the frusto-conical outer surface 48 of the ferrule 40 and the body scores 36 are axially extending and corresponding in shape to the axially oriented protrusions of the knurled portion 49 on the frusto-conical outer surface 48 of the ferrule 40. Thus, as the ferrule 40 is compressed by the frusto-conical inner surface 34 of the main body 10, the body scores 36 and knurled portion 49 interlock, preventing relative radial and axial movement of the main body 10 and ferrule 40. Alternatively, protrusions can be formed on the frusto-conical inner surface 34 of the main body 10 to engage indentations in the knurled portion 49 of the ferrule 40.

In the preferred embodiment, the front diameters of the frusto-conical surfaces 36 and 48 of the main body 10 and ferrule 40 are larger than the diameter of the generally cylindrical inner surface 14 at the front end 12 of the main body 10. This results in a small step 102 (FIG. 2) on the inner surface of the main body 10. The step 102 stops the forward movement of the ferrule 40 during assembly. Also, as noted above, the outer diameter of the rear end 30 of the main body 10 is larger than the outer diameter of the front end 12. This results in a thicker wall, illustrated in FIG. 2, which is better able to withstand the forces exerted by threading the coupling nut 50 onto the dummy jack 64. At the same time, the rear diameter of the frusto-conical surface 48 of the ferrule 40 is larger than the rear diameter of the frusto-conical inner surface 34 of the main body 10 both before and after compression of the ferrule 40 during assembly of the connector. This results in the rear end surface 44 of ferrule 40 sticking out beyond the rear surface 49 of the main body 10 when the front surface 70 of the ferrule 40 is flush against the step 102 on the inner surface of the main body 10. Thus, solid contact between the ferrule 40 and main body 10 is assured.

Figure 6:
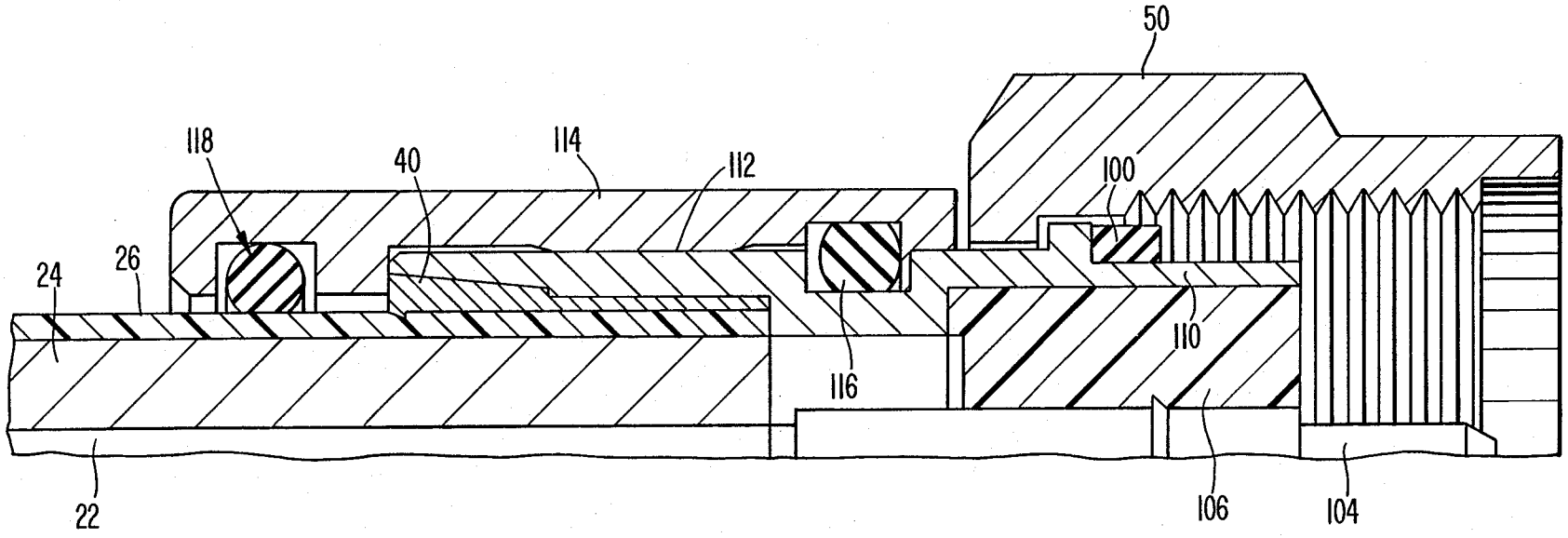
FIG. 6 is an axial cross-sectional view of an assembled coaxial cable connector according to a second embodiment of the present invention.

As illustrated in FIG. 6, the present invention can be applied to other types of coaxial cable connectors. For example, in the second embodiment illustrated in FIG. 6, a quasi-captive pin 104 is retained by a press-fit dielectric ring 106 which is inserted into a modified main body 110. In addition to the modifications to the front end of the main body to accept the press fit dielectric ring 106 and captive pin 104, the main body 110 includes outer engagement means, e.g., formed by knurled region 112, for securing a brass cap 114 which retains the coupling nut 50. A middle gasket 116 seals the front of the brass cap to the main body 110 and the brass cap 110 is sealed to the coaxial cable by rear ring 118. A ferrule 40 like that in the first embodiment provides contact between the outer conductor 26 and the main body 110.

The many features and advantages of the present invention are apparent in the detailed specification, and thus, it is intended by the appended claims to cover all such features and advantages of the connector which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to, falling within the scope and spirit of the invention.

What is claimed is:

1. A coaxial cable connector for joining a coaxial cable to a jack comprising:

(a) a main body having a front portion with a front end surface and generally cylindrical inner and outer surfaces, and a rear portion with a generally cylindrical outer surface and a frusto-conical inner surface with front and rear diameters;

(b) a ferrule locatable inside the rear portion of said main body between the main body and the outer conductor of the coaxial cable, the ferrule having an axial slit completely therethrough, a rear end surface, a generally cylindrical inner surface, a barb on the generally cylindrical inner surface, and a frusto-conical outer surface with front and rear diameters, the ferrule frusto-conical outer surface being engagable with the main body frusto-conical inner surface with the front diameters of the frusto-conical surfaces of said main body and said ferrule being smaller than the rear diameters of the frusto-conical surfaces of said main body and said ferrule; and (c) coupling means having a front portion with an open end for receiving a jack and a rear portion for receiving therein said ferrule with a shoulder engagable with said rear end surface of said ferrule, the shoulder having an inner diameter smaller than the rear diameter of the frusto-conical surface of said ferrule, and wherein, when opposing forces are exerted against the rear end surface of said ferrule and the front portion of said main body, said ferrule is caused to be radially compressed and the barb on the generally cylindrical inner surface of said ferrule is forced into the outer conductor of the coaxial cable.

2. A coaxial cable connector as recited in claim 1, wherein the front diameters of the frusto-conical surfaces of said main body and said ferrule are larger than the diameter of generally cylindrical inner surface at the front portion of said main body, and wherein the rear diameter of the frusto-conical surface of said ferrule is larger than the rear diameter of the frusto-conical surface of said main body both before and after compression.

3. A coaxial cable connector as recited in claim 2, wherein said ferrule has a generally cylindrical front outer surface with a diameter smaller than the front diameter of the frusto-conical rear outer surface of said ferrule and smaller than the diameter of generally cylindrical inner surface at the front portion of said main body.

4. A coaxial cable connector as recited in claim 1, wherein the frusto-conical surfaces of said main body and said ferrule meet in substantially face-to-face contact in an interlocking manner when said ferrule is compressed.

5. A coaxial cable connector as recited in claim 4, wherein the frusto-conical surface of said ferrule is knurled with axially oriented protrusions.

6. A coaxial cable connector as recited in claim 5, wherein the frusto-conical surface of said main body has axially extending identations corresponding in shape to the axially oriented protrusions in the frusto-conical surface of said ferrule.

7. A coaxial cable connector as recited in claim 1, wherein the barb on the generally cylindrical inner surface of said ferrule is formed by a continuous reduction of the inner diameter adjacent the rear end surface of said ferrule, forming in axial cross-section an acute angle on the inner surface of said ferrule.

8. A coaxial cable connector to be used in conjunction with a jack having an inner cylindrical surface and a threaded outer surface, said connector comprising:

a main body having a front portion with generally cylindrical inner and outer surfaces and a rear portion with a generally cylindrical outer surface and a frusto-conical inner surface with front and rear diameters and axially extending indentations;

a ferrule locatable inside the rear portion of said main body between the main body and the outer conductor of the cable, the ferrule having an axial slit completely therethrough, front and rear end surfaces, a generally cylindrical front portion having inner and outer surfaces with a barb formed by a continuing reduction of the inner diameter adjacent the rear end surface of said ferrule, and a rear portion having a frusto-conical outer surface with front and rear diameters and circumferential knurled region with axially oriented protrusions, the front diameters of the frusto-conical surfaces of said main body and said ferrule being larger than the diameter of generally cylindrical inner surface of the front portion on of said main body and smaller than the rear diameters of the frusto-conical surfaces of said main body an said ferrule, the rear diameter of the frusto-conical surface of said ferrule being larger than the rear diameter of the frusto-conical surface of said main body both before and after assembly of said connector; and coupling means having a front portion with a threaded inner surface for receiving the threaded outer surface of the jack and a rear portion for receiving herein said ferrule with a shoulder engagable with said rear end surface of said ferrule and with an inner diameter smaller than the rear diameter of the frusto-conical surface of said ferrule, and wherein, when opposing forces are exerted against the rear end surface of said ferrule and the front end surface of said main body, said ferrule is caused to be radially compressed and the barb on the generally cylindrical inner surface of said ferrule is forced into the outer conductor of the cable, substantially closing the axial slit therein and causing interlocking of the axially extending indentations on the frusto-conical inner surface of said main body and the axially oriented protrusions on the frusto-conical outer surface of said ferrule.

9. A method for assembling a coaxial cable connector onto a coaxial cable having an inner conductor separated from an outer conductor by a cable dielectric, the connector having a main body, a ferrule locatable inside the main body, and a coupling nut, the main body and the ferrule having generally tubular shapes and, front portions, each with a front end surface and generally cylindrical inner and outer surfaces, the main body having a rear portion with a generally cylindrical outer surface and a frusto-conical inner surface, the frusto-conical inner surface of the main body having front and rear diameters, the ferrule having an axial slit completely therethrough, a rear end surface, a generally cylindrical inner surface, a barb on the generally cylindrical inner surface and a frusto-conical rear outer surface with front and rear diameters, the front diameters of the frusto-conical surfaces of the main body and the ferrule being smaller that the rear diameters of the frusto-conical surfaces of the main body and the ferrule and the coupling nut having a threaded inner front surface and a rear shoulder with an inner diameter smaller that the rear diameter of the frusto-conical surface of the ferrule, said method comprising the steps of:

(a) preparing an end of the coaxial cable by stripping a portion of the cable dielectric and outer conductor to expose the inner conductor and form an end face of the cable dielectric and the outer conductor;

(b) sliding the coupling nut, the ferrule and main body in that order over the outer conductor at the end face until the front surface of the main body is aligned with the end face of the cable dielectric and the outer conductor, the ferrule being inserted in the main body without significant compression and rear shoulder of the coupling nut abutting the rear end surface of the ferrule;

(c) inserting the coaxial connector, aligned with the coaxial cable as recited in step (b), into an assembly tool having an anvil for accepting the coaxial cable and for exerting force against the rear shoulder of the coupling nut and a locator insertable between the threaded inner front surface of the coupling nut and the front end of the main body in face-to-face contact around substantially the entire circumference of the generally cylindrical outer surface at the front portion of the main body; and (d) exerting a first axial force against the rear shoulder of the coupling nut and a second, oppositely directed, axial force against the end face of the coaxial cable and the front end surface of the front portion of the main body thereby causing the frusto-conical surface of the main body to radially compress the ferrule, substantially closing the axial slit and causing the barb to engage the outer conductor of the coaxial cable.

10. A coaxial cable connector for joining a coaxial connector to a corresponding jack comprising:

(a) a coaxial cable including an outer conductor, a cable dielectric and an inner conductor separated from the outer conductor by the cable dielectric, the coaxial cable having a front end forming a face by the ends of the outer conductor and dielectric, thereby defining a reference plane with the end of the inner conductor extending therefrom;

(b) a one-piece, tubular-like main connector body including a rear portion with a rear frusto-conical inner surface and a front portion with a front end surface;

(c) a one-piece, tubular-like ferrule locatable inside the connector body between the outer conductor of the coaxial cable and the connector body and including front and rear end surfaces, an axial slit through the ferrule, a rear frusto-conical outer surface engagable with the rear frusto-conical inner surface of the connector body and a barb on the inner surface of the ferrule engagable with the outer conductor of the cable; and (d) a one piece coupling nut having an open-end front portion for receiving the corresponding jack therein and a rear portion for receiving the front end of the cable, the ferrule, and the connector body, the rear portion having a rear shoulder engagable with the rear end surface of the ferrule, wherein when opposing forces are exerted against the rear end surface of the ferrule and the front portion of the main body, the ferrule is radially compressed causing the axial slit to be substantially closed and the barb to engage the outer conductor of the cable and pull the outer conductor toward the front such that the front end surface of the ferrule, the front end surface of the main body, and the front end face of the cable will be substantially aligned in the reference plane.

* * * * *